US006838132B1

(12) United States Patent
Iguchi et al.

(10) Patent No.: US 6,838,132 B1
(45) Date of Patent: Jan. 4, 2005

(54) RECORDING SHEET AND METHOD FOR PREPARATION THEREOF

(75) Inventors: Yuji Iguchi, Tokyo (JP); Katsuaki Arai, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 11 days.

(21) Appl. No.: 09/806,030

(22) PCT Filed: Jul. 27, 2000

(86) PCT No.: PCT/JP00/05018

§ 371 (c)(1),
(2), (4) Date: Mar. 26, 2001

(87) PCT Pub. No.: WO01/09431

PCT Pub. Date: Feb. 8, 2001

(30) Foreign Application Priority Data

Jul. 29, 1999 (JP) ..... 11-215215

(51) Int. Cl.[7] ..... B41M 5/40

(52) U.S. Cl. ..... 428/32.16; 428/32.18; 428/32.33; 428/32.34; 428/32.37

(58) Field of Search ..... 428/32.16, 32.18, 428/32.33, 32.34, 32.37, 195, 304.4, 331

(56) References Cited

U.S. PATENT DOCUMENTS

| | | | | |
|---|---|---|---|---|
| 5,984,467 | A | 11/1999 | Bodager et al. | |
| 5,985,424 | A * | 11/1999 | DeMatte et al. | 428/212 |
| 6,028,028 | A * | 2/2000 | Nitta | 503/200 |
| 6,242,082 | B1 * | 6/2001 | Mukoyoshi et al. | 428/212 |
| 6,326,055 | B1 * | 12/2001 | Arai et al. | 427/195 |
| 6,358,605 | B1 * | 3/2002 | Casper | 428/343 |
| 6,391,825 | B1 * | 5/2002 | Arai et al. | 503/227 |

FOREIGN PATENT DOCUMENTS

| | | |
|---|---|---|
| DE | 695 01 864 T2 | 11/1998 |
| DE | 100 31 346 A1 | 1/2001 |
| JP | 60-204390 | 10/1985 |
| JP | 2-219679 | 9/1990 |
| JP | 7-119047 | 5/1995 |
| JP | 07-166465 A | 6/1995 |
| JP | 7-278996 | 10/1995 |
| JP | 7-292581 | 11/1995 |
| JP | 8-72387 | 3/1996 |
| JP | 8-90900 | 4/1996 |
| JP | 8-311784 | 11/1996 |
| JP | 9-86034 | 3/1997 |
| JP | 9-254524 | 9/1997 |
| JP | 10-6700 | 1/1998 |
| JP | 10-18165 | 1/1998 |
| JP | 10-18166 | 1/1998 |
| WO | 7-90780 | 4/1995 |

OTHER PUBLICATIONS

Datasheet for AEROSIL MOX 170, from Aerosil/Degussa Website printed on Jun. 16, 2002.*
German Office Action with Translation dated Nov. 20, 2003.

* cited by examiner

*Primary Examiner*—B. Shewareged
(74) *Attorney, Agent, or Firm*—Armstrong, Kratz, Quintos, Hanson & Brooks, LLP

(57) ABSTRACT

The object of the present invention is to provide an ink jet recording sheet which can give an image having an appearance looking like a picture, especially, an oil painting with maintaining sufficient print density. According to the present invention, there is provided an ink jet recording sheet comprising a support and an ink receiving layer provided on one side of the support, where the support is a fabric and the surface of the ink receiving layer has an arithmetical mean roughness of not more than 30 $\mu$m measured in accordance with JIS B0601. The present invention further provides an ink jet recording sheet mentioned above, wherein the ink receiving layer is coated on a pigment layer coated on at least one side of the fabric or on at least one side of the fabric impregnated with a pigment component. The ink receiving layer preferably contains a gas phase method silica.

10 Claims, No Drawings

RECORDING SHEET AND METHOD FOR PREPARATION THEREOF

TECHNICAL FIELD

The present invention relates to an ink jet recording sheet, and, more particularly, to an ink jet recording sheet having a fabric as a support and having sufficient ink jet applicability and peculiar feeling of picture.

BACKGROUND ART

Ink jet recording systems perform recording of images or letters by ejecting ink droplets according to various principles and depositing them onto recording sheets such as paper. The ink jet recording systems have the features that they can perform high-speed printing, produce little noise, are easy in multicolor printing, are great in versatility of patterns to be recorded, and require no development-fixation step, and they have rapidly spread in various uses as devices for recording various figures including Chinese letters and color images. Furthermore, the multicolor ink jetting systems are not inferior in the resulting color images to the multicolor printing according to the plate making systems. Moreover, when a small number of prints are to be produced, because of its cheapness, the systems are being widely applied to the field of full-color image recording.

As for the recording sheets used in the ink jet recording systems, efforts have been made from the side of apparatus or ink composition so that the general woodfree papers and coated papers for printing or writing can be used. However, with improvement in performances of ink jet recording apparatuses or expansion of uses, such as printing speed, minuteness of images, or full-color recording, ink jet recording sheets are also required to have the higher characteristics.

That is, they are required to have the following high image reproducibility: inked dots have a high density and a light and clear color tone; ink is quickly absorbed into the recording sheets, and even when an inked dot overlaps another inked dot, the ink does not flow or blot; inked dots do not diffuse in lateral direction more than needed; and inked dots have smooth and distinct perimeter lines.

Hitherto, papers or films have been used as supports for ink jet recording sheets. However, due to the recent diversification of taste, there have also be developed ink jet recording sheets using fabrics represented by woven fabrics as the supports.

Conventionally, printing of fabrics has been carried out by such printing methods as roller printing, screen printing, transfer printing, and the like, but owing to the recent tendency to produce many kinds of products in small quantities, printing by an ink jet recording method is now investigated. Specifically, Japanese Patent No. 1823665, Japanese Patent No. 1823666, JP-A-61-138785, JP-A-61-138786, and Japanese Patent No. 1785060, etc. disclose methods of carrying out printing on fabrics having an image receiving layer on one side by an ink jet recording method.

At present, printing on fabrics by ink jet recording systems is used for preparation of dyed samples. Apart from the printing field, it is proposed to produce duplicates of pictures utilizing ink jet recording sheets having fabrics as supports (JP-A-10-6700). However, at present, there have not yet been provided ink jet recording sheets from which picture-like, particularly, oil painting-like images can be obtained only by carrying out printing by ink jet recording systems.

Accordingly, the object of the present invention is to provide an ink jet recording sheet which can give images having a feeling of a picture, especially, an oil painting with maintaining sufficient print density.

DISCLOSURE OF INVENTION

As a result of intensive research conducted in an attempt to solve the above problems, the inventors have accomplished the following invention.

That is, the present invention provides an ink jet recording sheet having an ink receiving layer on one side of a support, wherein the support is a fabric and the surface of the ink receiving layer has an arithmetical mean roughness of not more than 30 $\mu$m measured in accordance with JIS B0601.

The fabric preferably has a pigment layer on at least the side on which the ink receiving layer is provided or is impregnated with a pigment component.

The surface of the ink receiving layer preferably has a 75° specular gloss of not less than 10 measured in accordance with JIS P8142.

The fabric is preferably a woven fabric comprising yarns having a diameter of not less than 200 $\mu$m.

More preferably, the ink receiving layer contains a gas phase method silica.

More preferably, said gas phase method silica has an average primary particle diameter of 3–40 nm and a specific surface area of not less than 50 $m^2/g$ measured by BET method.

The present invention further provides a method for producing an ink jet recording sheet which comprises calendering a fabric coated with a pigment layer on at least one side or impregnated with a pigment component and then coating an ink receiving layer on the pigment layer or on one side of the fabric impregnated with the pigment component.

BEST MODE FOR CARRYING OUT THE INVENTION

A picture, particularly, an oil painting is made by drawing figures on a canvas of an undercoated fabric comprising jute yarns. Features of the surface of drawn oil paintings are (1) a stereoscopic feeling developed by unevenness in textures of the fabric and (2) a glossy feeling as an expression method. As a result of intensive investigation conducted by the inventors on the formation of picture-like images by ink jet recording systems, it has been found that ink jet recording sheets satisfying one or both of the above conditions can provide picture-like images after printed.

That is, in the ink jet recording sheet of the present invention, the support is a fabric, a fabric coated with a pigment layer on at least one side or a fabric impregnated with a pigment component, one side of the fabric is coated with an ink receiving layer, and the surface of the ink receiving layer has an arithmetical mean roughness of not more than 30 $\mu$m measured in accordance with JIS B0601.

The greater unevenness of the surface of the ink receiving layer is naturally preferred because the stereoscopic feeling is more accentuated, but too great unevenness causes deterioration of print density in ink jet recording. The inventors have investigated this point and, as a result, it has been found that the stereoscopic feeling of the surface of the ink receiving layer and the print density can be balanced by using a fabric as a support and setting the arithmetical mean roughness of the ink receiving layer at not more than 30 $\mu$m. The arithmetical mean roughness is more preferably 3–25 $\mu$m.

As to the glossy feeling as an element for images looking like oil painting, although an ink jet recording sheet having a gloss which uses paper or film as a support shows higher gloss, when an oil printing image is printed thereon, the printed image can never give a feeling of an oil painting. The inventors have also investigated this point, and, as a result, it has been found that the printed images become closer to oil paintings by using a fabric as a support and setting the 75° specular gloss of the surface of the ink receiving layer at not less than 10. Thus the present invention has been accomplished. The 75° specular gloss is more preferably not less than 15. There is no special upper limit, but when the support is a fabric, a 75° specular gloss of more than 50 is considerably difficult to obtain and, besides, there is no need to employ such a 75° specular gloss.

As means for attaining the arithmetical mean roughness of not more than 30 μm measured in accordance with JIS B0601 for the surface of the ink receiving layer and the 75° specular gloss of not less than 10 measured in accordance with JIS P8142 for the surface of the ink receiving layer, there are (1) selecting suitable thickness of yarns constituting the fabric or selecting the weaving method, (2) providing a pigment layer on the fabric used as a support or impregnating the fabric with a pigment component, (3), furthermore, subjecting the fabric provided with the pigment layer to calendering treatment, (4) using microfine particles as the pigment in the ink receiving layer (for example, alumina hydrate, gas phase method silica, etc.), (5) after providing the ink receiving layer, carrying out a surface treatment using a calender such as machine calender, super calender, or soft-calender, and others.

The fabrics used as a support in the present invention are general woven fabrics, knitted fabrics, nonwoven fabrics and the like. As the fibers constituting these fabrics, there may be used organic synthetic fibers, for example, polyester fibers of homopolymers and copolymers such as polyethylene terephthalate, polybutylene terephthalate and modified polymers of them, polyolefin fibers of homopolymers and copolymers such as polypropylene, polyethylene, polystyrene and modified polymers of them, polyacrylo-nitrile fibers such as acrylic fibers and modacrylic fibers, nylon fibers such as such as nylon 6 and nylon 66, polyvinyl alcohol fibers, and urethane fibers; regenerated fibers such as regenerated cellulose fibers, e.g., rayon and fibers obtained by spinning a solution of collagen, alginic acid, chitin or the like; semisynthetic fibers such as acetate fibers; natural fibers such as vegetable fibers of hemp and cotton and protein fibers such as wool and silk; inorganic fibers such as metallic fibers, glass fibers and carbon fibers. These may be used each alone or in combination.

The nonwoven fabrics used in the present invention are roughly classified into wet nonwoven fabrics, dry nonwoven fabrics made by stitch bond method, spun bond method, melt blown method, thermal bond method and the like, and spun lace nonwoven fabrics using wet nonwoven fabrics or dry nonwoven fabrics.

In the present invention, it is preferred to use woven fabrics comprising yarns of 200 μm or more in diameter since more oil painting-like images can be expressed. However, in case the diameter of yarns is too large, it becomes difficult to adjust the arithmetical mean roughness of the surface of the ink receiving layer to 30 μm or less, and, hence, the diameter of yarns preferably does not exceed 1000 μm. The diameter of yarns mentioned herein is a mean value of diameters of the yarns extracted from optional several parts of a woven fabric which are measured by a micrometer.

The woven fabrics used as supports in the present invention are made by general known weaving methods such as plain weaving, twill weaving, sateen weaving, etc. Preferred is a plain weave fabric. Moreover, the diameter of yarns may be partially changed as far as the effect of the present invention is not damaged.

In one embodiment of the present invention, an ink receiving layer is coated on one side of a fabric coated with a pigment layer or a fabric impregnated with a pigment component. The pigment layer or the pigment component has the effects to fill up the voids present at intersections of warps and wefts constituting the fabric or to level differences present between warp and weft. Therefore, the ink receiving layer can readily exist in the form of a layer on the surface and good ink jet applicability can be attained.

The pigments contained in the pigment layer or the pigment component are not limited, and examples thereof are kaolin clay, delaminated clay, calcined clay, heavy calcium carbonate, precipitated (light) calcium carbonate, aluminum hydroxide, talc, titanium dioxide, calcium sulfate, barium sulfate, zinc oxide, zinc sulfide, zinc carbonate, satin white, aluminum silicate, diatomaceous earth, calcium silicate, magnesium silicate, synthetic amorphous silica, colloidal silica, colloidal alumina, pseudoboehmite, alumina, lithopone, zeolite, hydrated halloysite, magnesium carbonate, and magnesium hydroxide.

The pigment layer and the fabric impregnated with the pigment component preferably contain an adhesive in addition to the pigment component. As latex adhesives, there may be used conjugated diene copolymer latices such as styrene-butadiene copolymer, acrylic polymer latices such as polymers or copolymers of acrylate esters and/or methacrylate esters, vinyl polymer latices such as styrene-vinyl acetate copolymer, and alkali-reactive or alkali-non-reactive polymer latices prepared by modifying these various polymer latices with monomers containing a functional group such as carboxyl group. Especially preferred are conjugated diene copolymer latices such as styrene-butadiene copolymer from the points of pigment bonding force, operability, cost and others.

As other adhesives, there may also be used natural adhesives such as oxidized starches, etherified starches, esterified starches, enzyme-modified starches, cold water-soluble starches obtained by flash drying these starches, casein, and soybean protein.

In order to enhance water retention properties, there may be further added water retaining agents such as alkali thickening type latices, carboxymethyl cellulose, methyl cellulose and sodium alginate.

In addition, generally employed assistants, e.g., dispersing agent, thickening agent, anti-foaming agent, lubricant, dye, and pH adjustor can be optionally used.

Compositions for the pigment layer or the pigment component in the present invention can be easily prepared by weighing each of the above ingredients and mixing them by dispersing machines such as Kohles dispersing machine and Kady mill.

Amount of the adhesive contained in the pigment layer or the pigment component is preferably 5–50 parts by weight based on 100 parts by weight of the pigment. By containing the adhesive in the above range, ink jet print density can be improved with maintaining the appearance of fabric. If the amount of the adhesive is less than 5 parts by weight, gloss of the printed surface of the recording sheet decreases or adhesion becomes weak, and if it is more than 50 parts by weight, gloss and adhesion are sufficient, but voids of the pigment are filled up due to excess covering power and, hence, absorption properties are markedly deteriorated.

The pigment layer in the present invention can be coated on the fabric by using any coating head such as air knife coater, various blade coaters or roll coaters. Furthermore, the fabric can be impregnated with the pigment component by a coating device such as size press or tab size press. In this case, amount of the pigment layer or the pigment component to be impregnated is preferably in the range of 5–250 g/m$^2$, more preferably 10–200 g/m$^2$ in absolute dry weight. If the coating amount is less than 5 g/m$^2$, the effect to improve the print density cannot be obtained, and if it is more than 250 g/m$^2$, peeling of the coat may occur or feeling of a fabric is deteriorated.

In the ink jet recording sheet of the present invention, an ink receiving layer containing a pigment and an adhesive must be coated on one side of the fabric which is a support. For this purpose, there may be employed coating devices such as various blade coaters, roll coaters, air knife coaters, bar coaters, rod blade coaters, short dwell coaters, comma coaters, die coaters, reverse roll coaters, kiss-roll coaters, dip coaters, curtain coaters, extrusion coaters, gate roll coaters, gravure coaters, micro-gravure coaters, size presses, and tab-size presses.

Coating amount of the ink receiving layer in the ink jet recording sheet of the present invention is not especially limited, but is preferably 5–50 g/m$^2$, more preferably 10–40 g/m$^2$. If the coating amount is less than 5 g/m$^2$, ink absorbability is deteriorated to cause spreading of the ink. If the coating amount exceeds 50 g/m$^2$, the ink receiving layer thickly covers the surface of the fabric, and, hence, the stereoscopic feeling of the surface of the ink receiving layer is damaged or the ink receiving layer exfoliates to cause deterioration of print quality.

The ink receiving layer used in the present invention can contain one or more known white pigments. Examples thereof are white inorganic pigments such as precipitated calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudoboehmite, aluminum hydroxide, alumina, lithopone, zeolite, hydrated halloysite, magnesium carbonate, and magnesium hydroxide, and organic pigments such as styrene plastic pigments, acrylic plastic pigments, polyethylene, microcapsules, urea resin and melamine resin. Among them, synthetic amorphous silica, magnesium carbonate and alumina hydrates and the like are preferred as white pigments contained as a main component in the ink receiving layer, and synthetic amorphous silica, especially, gas phase method silica is especially preferred from the points of gloss and colorfulness.

In the present invention, it is preferred that the ink receiving layer contains mainly gas phase method silica. Since the ink receiving layer using gas phase method silica can form a film which has high transparency and retains the feeling of the support and can give gloss, glossy feeling and stereoscopic feeling expressed by unevenness of weaves can be obtained. Here, "containing mainly gas phase method silica" means to contain gas phase method silica in an amount of not less than 50% by weight, preferably not less than 60% by weight based on total solid content constituting the coating composition.

Amorphous synthetic silica includes one prepared by wet method and one prepared by gas phase method. Normally, the term "silica fine particles" means the silica prepared by wet method. The wet method silica includes (1) silica sol obtained by double decomposition of sodium silicate with an acid or the like or by passing through an ion exchange resin layer, (2) colloidal silica obtained by aging said silica sol with heating, (3) silica gel obtained by allowing silica sol to gel with changing the production conditions thereof, thereby producing three-dimensional secondary particles formed through siloxane bonding of primary particles of several microns to about 10 microns, and (4) synthetic silicic acid compounds mainly composed of silicic acid which are obtained by heating silica sol, sodium silicate, sodium aluminate or the like.

The gas phase method silica which is used preferably in the present invention is called dry method silica in contrast to wet method and is generally produced by flame hydrolysis method. Specifically, a method of combustion of silicon tetrachloride together with hydrogen and oxygen is generally known, and in place of the silicon tetrachloride, there may be used silanes such as methyltrichlorosilane and trichlorosilane each alone or in admixture with silicon tetrachloride. The gas phase method silica is commercially available from Japan Aerosil Co., Ltd. and Tokuyama Co., Ltd.

Average particle diameter of the primary particles of the gas phase method silica preferably used in the present invention is preferably not more than 50 nm, and more preferably 3–40 nm with a specific surface area of not less than 50 m$^2$/g according to BET method, and further preferably 3–15 nm with a specific surface area of not less than 200 m$^2$/g according to BET method. The BET method in the present invention is one of the methods for the measurement of surface area of powders by gas phase adsorption method, and is a method by which total surface area possessed by 1 g of a sample from an adsorption isothermic curve, namely, the specific surface area. Ordinarily, nitrogen gas is often used as the gas to be adsorbed, and a method of measuring the adsorption amount from change in pressure or volume of the gas to be adsorbed is used most often. The most famous for expressing isothermic curve of adsorption of many molecules is the equation of Brunauer, Emmett, Teller, and this is called BET method and is widely used for determination of surface area. An adsorption amount obtained from the BET equation is multiplied by an area which is occupied by one adsorbed molecule on the surface, thereby obtaining the surface area.

The feature of the gas phase method silica is that primary particles are linked together in the form of network structure or in the form of chains and are present in the secondarily agglomerated state, whereby a high ink absorbability can be obtained. The state of the-secondary agglomeration is preferably kept at about 50–500 nm, whereby a high ink absorbability can be obtained without deteriorating the glossiness. When it is used for fabrics, a film can be formed with retaining feeling of fabrics. Therefore, it is preferred to previously add various dispersion stabilizers to a solution of gas phase method silica and to treat the solution by a dispersing machine such as ball mill or high-pressure homogenizer.

As adhesives used in the ink receiving layer of the present invention, mention may be made of aqueous adhesives, e.g., polyvinyl alcohol, vinyl acetate, oxidized starch, etherified starch, cellulose derivatives such as carboxymethyl cellulose and hydroxyethyl cellulose, casein, gelatin, soybean protein, silyl-modified polyvinyl alcohol; conjugated diene copolymer latices such as styrene-butadiene copolymer and methyl methacrylate-butadiene copolymer; acrylic polymer latices such as polymers or copolymers of acrylate esters and methacrylate esters and polymers or copolymers of acrylic acid and methacrylic acid; vinyl polymer latices such as ethylene-vinyl acetate copolymer; or functional group-modified polymer latices prepared by modifying these various polymers with monomers containing a functional group such as carboxyl group; or thermosetting synthetic resins such as melamine resin and urea resin; and synthetic resin adhesives such as polymethyl methacrylate, polyurethane resin, unsaturated polyester resin, vinyl chloride-vinyl acetate copolymer, polyvinyl butyral and alkyd resin. These may be used each alone or in combination.

Especially preferred hydrophilic adhesives are completely or partially saponified polyvinyl alcohol, silanol-modified polyvinyl alcohol or cation-modified polyvinyl alcohol, and the like.

The most preferred polyvinyl alcohols are partially or completely saponified polyvinyl alcohols having a saponification degree of 80 or higher and an average polymerization degree of about 200–5000.

The cation-modified polyvinyl alcohols include, for example, those which have primary-tertiary amino groups or quaternary ammonium groups in a main chain or a side chain of polyvinyl alcohol such as disclosed in JP-A-61-10483.

Other hydrophilic adhesives can be used additionally, but are preferably used in an amount of not more than 20% by weight based on the polyvinyl alcohol. Amount of the hydrophilic adhesive used together with the pigment for ink receiving layer is not more than 50% by weight, preferably 30–1% by weight based on the pigment of the ink receiving layer.

In the ink receiving layer of the present invention, in addition to the preferably used gas phase method silica and hydrophilic adhesives, there may be used mainly dispersion stabilizers for enhancing dispersion stability of the gas phase method silica and improving gloss and ink absorbability, cationic compounds for improving water resistance, light resistance and high-humidity blotting of ink jet ink, hardeners for inhibiting damage of voids of the ink receiving layer caused by swelling with hydrophilic adhesive at the time of printing.

Conventionally known inorganic and organic dispersion stabilizers can be used as the dispersion stabilizers in the present invention. As the organic dispersion stabilizers, there may be used various anionic, nonionic and cationic dispersion stabilizers. Preferred are cationic dispersion stabilizers, and more preferred are polydiallylamine derivatives. Examples of the polydiallylamine derivatives are those which contain $SO_2$ group in the recurring units as disclosed in JP-A-60-83882 and copolymers with acrylamides as disclosed in JP-A-1-9776.

Specifically, the polydiallylamine derivatives used in the present invention are commercially available in the name of SHALLOL DC-902P from Dai-ichi Kogyo Seiyaku Co., Ltd., in the name of JETFIX 110 from Satoda Kako Co., Ltd., and in the name of UNICENCE CP-101 from Senka Co., Ltd. Molecular weight of the cationic polymer of the polydiallylamine derivative used in the present invention is preferably not more than 100,000, more preferably about 2,000–50,000 from the point of dispersion stabilization of the gas phase method silica.

Amount of the dispersion stabilizer used in the present invention is 1–10 parts, preferably 2–7 parts based on 100 parts of the gas phase method silica. If the amount of the dispersion stabilizer is larger than the above range, ink absorbability of the ink receiving layer deteriorates and it it is too small, dispersion stability of the gas phase method silica in the coating solution deteriorates, resulting in decrease of film transparency after drying the ink receiving layer. That is, appearance peculiar to fabrics is damaged.

Addition of the dispersion stabilizer in the process of preparation of a coating composition containing the gas phase method silica may be carried out by dispersing the gas phase method silica in the presence of the dispersion stabilizer or by adding after dispersing the gas phase method silica. However, it is important to add the dispersion stabilizer to the dispersion of the gas phase method silica before the addition of the hydrophilic adhesive such as polyvinyl alcohol. By such addition, dispersion stability of the gas phase method silica is improved. As afore-mention, dispersion of the gas phase method silica can be carried out using generally known dispersing machines such as high-pressure homogenizer and ball mill.

The cationic compounds contained in the ink receiving layer in the present invention include cationic polymers and inorganic cationic compounds. Examples of the cationic polymers are dicyandiamide derivatives, polyalkylenepolyamine derivatives, polyamine derivatives, polyallylamine derivatives, acrylamine derivatives, polyethyleneimine derivatives, reaction products of low-molecular polyfunctional amines with polyfunctional compounds for amino group, such as epihalohydrin, and polyamideepichlorohydrin derivatives. At least one of them can be contained. Specifically, the epichlorohydrin derivatives are available in the name of PAPIOGEN from Senka Co., Ltd. and in the name of JETFIX from Satoda Kako Co., Ltd.

Molecular weight of the cationic polymers is not especially limited, but is preferably not more than 100,000 in the case of adding to the gas phase method silica solution so that dispersibility of the gas phase method silica is not deteriorated. Moreover, dullness of images can be further improved by using the gas phase method silica and the cationic polymer in combination in the present invention.

The inorganic cationic compounds include water-soluble salts of metals selected from calcium, barium, manganese, copper, cobalt, nickel, aluminum, iron, zinc, zirconium, chromium, magnesium, tungsten, and molybdenum. Examples of them are calcium acetate, calcium chloride, calcium formate, calcium sulfate, barium acetate, barium sulfate, barium phosphate, manganese chloride, manganese acetate, manganese formate dihydrate, ammonium manganese sulfate hexahydrate, cupric chloride, ammonium cupric (II) chloride dihydrate, copper sulfate, cobalt chloride, cobalt thiocynate, cobalt sulfate, nickel sulfate hexahydrate, nickel chloride hexahydrate, nickel acetate tetrahydrate, ammonium nickel sulfate hexahydrate, nickel amidosulfate tetrahydrate, aluminum sulfate, aluminum sulfite, aluminum thiosulfate, polyaluminum chloride, aluminum nitrate nonahydrate, aluminum chloride hexahydrate, ferrous bromide, ferrous chloride, ferric chloride, ferrous sulfate, ferric sulfate, zinc bromide, zinc chloride, zinc nitrate hexahydrate, zinc sulfate, zirconium acetate, zirconium chloride, zirconium chloride oxide octahydrate, zirconium hydroxychloride, chromium acetate, chromium sulfate, magnesium sulfate, magnesium chloride hexahydrate, magnesium citrate nonahydrate, sodium phosphotungstate, tungsten sodium citrate, dodecatungustophosphoric acid n-hydrate, dodecatungstosilicic acid hexacosahydrate, molybdenum chloride, dodecamolybdophosphoric acid n-hydrate, and the like.

In the present invention, water-soluble aluminum compounds are especially preferred, and examples thereof are aluminum chloride or hydrates thereof, aluminum sulfate or hydrates thereof and aluminum alum. Moreover, there are basic polyaluminum hydroxide compounds which are inorganic aluminum-containing cationic polymers. Especially preferred is a basic polyaluminum hydroxide.

These are commercially available in the name of polyaluminum chloride (PAC) from Tagi Kagaku Co., Ltd. as water treating agents, in the name of polyaluminum hydroxide (Paho) from Asada Kagaku Co., Ltd., in the name of PURACHEM WT from Riken Green Co., co Ltd., and from other makers for the similar purposes, and those of various grades can be easily available. In the present invention, these commercially available products can be utilized as they are, but they may be optionally adjusted in pH.

These cationic compounds may be contained in the ink receiving layer by any methods. For example, there are a method of dissolving or dispersing them in suitable solvents and impregnating or coating the solution or dispersion after coating the ink receiving layer and a method of containing them in coating solutions for the ink receiving layer.

Amount of the cationic compounds used in the present invention is 0.5–30 parts, preferably 1–15 parts based on 100 parts of the pigment. If the amount of the cationic polymer for the pigment is more than 15 parts, ink absorbability is deteriorated. If the amount is less than 1 part, water resistance of the sheet decreases or blotting of ink at high humidity occurs.

Examples of the hardeners used in the present invention are aldehyde compounds such as formaldehyde and glutaraldehyde, ketone compounds such as diacetyl and chloropentanedione, bis(2-chloroethylurea)-2-hydroxy-4,6-dichloro-1,3,5-triazine, compounds having reactive halogens as disclosed in U.S. Pat. No. 3,288,775, divinyl sulfone, compounds having reactive olefins as disclosed in U.S. Pat. No. 3,635,718, N-methyol compounds as disclosed in U.S. Pat. No. 2,732,316, isocyanates as disclosed in U.S. Pat. No. 3,103,437, aziridine compounds as disclosed in U.S. Pat. Nos. 3,017,280 and 2,983,611, carbodiimide compounds as disclosed in U.S. Pat. No. 3,100,704, epoxy compounds as disclosed in U.S. Pat. No. 3,091,537, halogen carboxyaldehydes such as mucochloric acid, dioxane derivatives such as dihydroxydioxane, and inorganic hardeners such as chromium alum, zirconium sulfate, boric acid, and borates. These can be used each alone or in combination of two or more. Boric acid and borates are especially preferred. Amount of the hardeners is preferably 0.01–10 g, more preferably 0.1–5 g based on 100 g of the water-soluble polymer in the ink receiving layer.

Various oil drops may be added to the ink receiving layer for improving fragility of the coated layer. Examples of the oil drops are hydrophobic high-boiling point organic solvents having a solubility of not more than 0.01% by weight in water at room temperature (such as liquid paraffin, dioctyl phthalate, tricresyl phosphate, and silicone oil) and polymer particles (for example, particles obtained by polymerizing at least one polymerizable monomers such as styrene, butyl acrylate, divinylbenzene, butyl methacrylate and hydroxyethyl methacrylate). The oil drops can be used in an amount of preferably 10–50% by weight based on the hydrophilic adhesive.

The ink receiving layer of the present invention can contain surface active agents. The surface active agents may be any of anionic type, cationic type, nonionic type and betaine type, and can be low molecular or high molecular ones. One or two or more of the surface active agents are added to the ink receiving later, and in the case of using two or more surface active agents in combination, it is not preferred to use anionic one and cationic one in combination. Amount of the surface active agents is preferably 0.001–5 g, more preferably 0.01–3 g based on 100 g of the adhesive constituting the ink receiving layer.

Furthermore, the ink receiving layer may further contain various known additives such as coloring dyes, coloring pigments, ultraviolet absorbers, antioxidants, antifoaming agents, preservatives, fluorescent brighteners, viscosity stabilizers, pH adjustors, and silane or titanium coupling agents.

Moreover, the ink receiving layer may contain pigment dispersants, thickening agents, fluidity improving agents, foam-inhibitors, releasing agents, foaming agents, penetrating agents, coloring dyes, coloring pigments, mildew-proofing agents, water resisting agents, wet strengthening agents, and dry strengthening agents.

In order to further enhance the glossy feeling of the ink jet recording sheets of the present invention, after coating the pigment layer on the fabric as a support, the coated fabric is subjected to a surface treatment using a calender such as machine calender, super calender or soft calender, thereby improving the gloss of the surface of the pigment layer and then an ink receiving layer is provided on the pigment layer and gloss of the surface of the ink receiving layer is developed, or after coating the pigment layer, an ink receiving layer is provided without carrying out the surface treatment, and then is subjected to the surface treatment to develop gloss of the surface of the ink receiving layer.

The present invention will be explained by the following examples, which do not limit the invention. All "part" and "%" in the examples and comparative examples are part by weight and % by weight unless otherwise notified.

(Preparation of Solution 1 for Ink Receiving Layer)

A solution of 15% in solid concentration was prepared using 10 parts of a synthetic amorphous silica (FINESIL X37B manufactured by Tokuyama Soda Co., Ltd.), 130 parts of a polyvinyl alcohol (PVA 117 manufactured by Kuraray Co., Ltd.) and 20 parts of a cationic dye fixing agent (SUMIREZ Resin 1001 manufactured by Sumitomo Chemical Co., Ltd.). The resulting solution was referred to as Solution 1 for ink receiving layer.

(Preparation of Solution 2 for Ink Receiving Layer)

To a dispersion medium of water:ethyl alcohol=20:1 were added 100 parts of a gas phase method silica (AEROSIL 380 manufactured by Japan Aerosil Co., Ltd.; average primary particle diameter: 7 nm; specific surface area according to BET method: 380 $m^2/g$), 4 parts of a cationic polymer (SHALLOL DC902P manufactured by Dai-ichi Kogyo Seiyaku Co., Ltd.) and 4 parts of a cationic compound (basic polyaluminum hydroxide: Trademark: PYURACHEM WT manufactured by Riken Green Co., Ltd.), followed by dispersing using a high-pressure homogenizer. Thereafter, to the dispersion were added 6 parts of boric acid, 20 parts of a polyvinyl alcohol (PVA 235 manufactured by Kuraray Co., Ltd.; saponification degree: B88%; average polymerization degree: 3500), 0.3 part of a surface active agent (SWAM AM-2150 manufactured by Japan Surfactant Co., Ltd.) to prepare a coating solution (total solid concentration 10%). This was referred to as Solution 2 for ink receiving layer.

(Preparation of Solution 3 for Ink Receiving Layer)

Solution 3 for ink receiving layer was prepared in the same manner as in preparation of Solution 2, except that 100 parts of a gas phase method silica (QS-30 manufactured by Tokuyama Co., Ltd.; average primary particle diameter: 9 nm; specific surface area according to BET method: 300 $m^2/g$) was used in place of 100 parts of the gas phase method silica (AEROSIL 380 manufactured by Japan Aerosil Co., Ltd.; average primary particle diameter: 7 nm; specific surface area according to BET method: 380 $m^2/g$).

(Preparation of Solution 4 for Ink Receiving Layer)

Solution 4 for ink receiving layer was prepared in the same manner as in preparation of Solution 2, except that 100 parts of a gas phase method silica (AEROSIL 200 manufactured by Japan Aerosil Co., Ltd.; average primary particle diameter: 12 nm; specific surface area according to BET method: 200 $m^2/g$) was used in place of 100 parts of the gas phase method silica (AEROSIL 380 manufactured by Japan Aerosil Co., Ltd.; average primary particle diameter: 7 nm; specific surface area according to BET method: 380 $m^2/g$).

(Preparation of Solution 5 for Ink Receiving Layer)

Solution 5 for ink receiving layer was prepared in the same manner as in preparation of Solution 2, except that 100 parts of a gas phase method silica (AEROSIL 90G manufactured by Japan Aerosil Co., Ltd.; average primary particle diameter: 20 nm; specific surface area according to BET method: 90 $m^2/g$) was used in place of 100 parts of the gas phase method silica (AEROSIL 380 manufactured by Japan Aerosil Co., Ltd.; average primary particle diameter: 7 nm; specific surface area according to BET method: 380 $m^2/g$).

(Preparation of Solution 6 for Ink Receiving Layer)

Solution 6 for ink receiving layer was prepared in the same manner as in preparation of Solution 2, except that 100 parts of a gas phase method silica (AEROSIL OX50 manufactured by Japan Aerosil Co., Ltd.; average primary particle diameter: 40 nm; specific surface area according to BET method: 50 $m^2/g$) was used in place of 100 parts of the gas phase method silica (AEROSIL 380 manufactured by Japan Aerosil Co., Ltd.; average primary particle diameter: 7 nm; specific surface area according to BET method: 380 $m^2/g$).

(Preparation of Solution 1 For Pigment Layer)

A dispersion of 70% by weight in solid concentration was prepared using 100 parts by weight of a second class grade clay (PREDISPERSED HT manufactured by EM Co., Ltd.) as a pigment, 0.4 part by weight of sodium polyacrylate as a dispersing agent and 0.1 part by weight of carboxymethyl cellulose as a water retaining agent, and 4 parts of a styrene-butadiene latex adhesive was added to the dispersion, followed by stirring. Then, NaOH was added so as to give a pH of 9.5, and water was added to obtain a coating composition having a solid concentration of 62% by weight. This was referred to as Solution 1 for pigment layer.

(Preparation of Solution 2 for Pigment Layer)

A dispersion of 60% by weight in solid concentration was prepared using 80 parts by weight of a precipitated calcium carbonate (BRILLIANT 15 manufactured by Shiraishi Kogyo Co., Ltd.) and 20 parts by weight of titanium dioxide (TIPAQUE A220 manufactured by Ishihara Sangyo Co., Ltd.) as pigments, 0.4 part by weight of sodium polyacrylate as a dispersing agent and 0.1 part by weight of carboxymethyl cellulose as a water retaining agent, and 10 parts of a styrene-butadiene latex adhesive was added to the dispersion, followed by stirring. Then, water was added to obtain a coating composition having a solid concentration of 55% by weight. This was referred to as Solution 2 for pigment layer.

EXAMPLE 1

One side of a polyester fabric (a plain weave fabric comprising of filament yarns having a diameter of 100 $\mu$m) as a support was coated with Solution 1 for ink receiving layer by a wire bar so as to give a coating amount of 10 $g/m^2$ after drying, followed by drying the coated fabric to obtain an ink jet recording sheet of Example 1. The surface of the ink receiving layer had an arithmetical mean roughness of 20 $\mu$m and a 75° specular gloss of 9.

EXAMPLE 2

The ink jet recording sheet obtained in Example 1 was subjected to calendering treatment (passing twice under a linear pressure of 160 kg/cm) to obtain an ink jet recording sheet of Example 2. The surface of the ink receiving layer had an arithmetical mean roughness of 14 $\mu$m and a 75° specular gloss of 24.

EXAMPLE 3

The ink jet recording sheet obtained in Example 1 was subjected to calendering treatment (passing twice under a linear pressure of 240 kg/cm) to obtain an ink jet recording sheet of Example 3. The surface of the ink receiving layer had an arithmetical mean roughness of 8 $\mu$m and a 75° specular gloss of 34.

EXAMPLE 4

One side of a polyester fabric (a plain weave fabric comprising filament yarns having an outer diameter of 100 $\mu$m) as a support was coated with Solution 1 for pigment layer by a wire bar so as to give a coating amount of 100 $g/m^2$ after drying, followed by drying the coated fabric. Then, Solution 1 for ink receiving layer prepared in the preliminary operation was coated on the pigment layer by a wire bar so as to give a coating amount of 10 $g/m^2$ after drying and was dried to obtain an ink jet recording sheet of Example 4. The surface of the ink receiving layer had an arithmetical mean roughness of 17 $\mu$m and a 75° specular gloss of 14.

EXAMPLE 5

The ink jet recording sheet obtained in Example 4 was subjected to calendering treatment (passing twice under a linear pressure of 160 kg/cm) to obtain an ink jet recording sheet of Example 5. The surface of the ink receiving layer had an arithmetical mean roughness of 10 $\mu$m and a 75° specular gloss of 28.

EXAMPLE 6

The ink jet recording sheet obtained in Example 4 was subjected to calendering treatment (passing twice under a linear pressure of 240 kg/cm) to obtain an ink jet recording sheet of Example 6. The surface of the ink receiving layer had an arithmetical mean roughness of 2 $\mu$m and a 75° specular gloss of 38.

EXAMPLE 7

An ink jet recording sheet of Example 7 was obtained in the same manner as in Example 1, except that the fabric used was changed to a plain weave polyester fabric comprising yarns having an outer diameter of 230 $\mu$m. The surface of the ink receiving layer had an arithmetical mean roughness of 29 $\mu$m and a 75° specular gloss of 8.

EXAMPLE 8

The ink jet recording sheet obtained in Example 7 was subjected to calendering treatment (passing twice under a linear pressure of 160 kg/cm) to obtain an ink jet recording sheet of Example 8. The surface of the ink receiving layer had an arithmetical mean roughness of 21 $\mu$m and a 75° specular gloss of 13.

EXAMPLE 9

The ink jet recording sheet obtained in Example 7 was subjected to calendering treatment (passing twice under a linear pressure of 240 kg/cm) to obtain an ink jet recording sheet of Example 9. The surface of the ink receiving layer had a center line average roughness of 15 μm and a 75 specular gloss of 21.

EXAMPLE 10

An ink jet recording sheet of Example 10 was obtained in the same manner as in Example 4, except that the fabric used was changed to a plain weave polyester fabric comprising yarns having an outer diameter of 230 μm. The surface of the ink receiving layer had an arithmetical mean roughness of 23 μm and a 75° specular gloss of 10.

EXAMPLE 11

The ink jet recording sheet obtained in co Example 10 was subjected to calendering treatment (passing twice under a linear pressure of 160 kg/cm) to obtain an ink jet recording sheet of Example 11. The surface of the ink receiving layer had an arithmetical mean roughness of 6 A4m and a 75° specular gloss of 27.

EXAMPLE 12

The ink jet recording sheet obtained in Example 10 was subjected to calendering treatment (passing twice under a linear pressure of 240 kg/cm) to obtain an ink jet recording sheet of Example 12. The surface of the ink receiving layer had an arithmetical mean roughness of 4 μm and a 75° specular gloss of 31.

EXAMPLE 13

One side of a polyester fabric (a plain weave fabric comprising filament yarns of 100 μm in diameter) as a support was coated with Solution 2 for ink receiving layer by a wire bar so as to give a coating amount of 10 g/m$^2$ after drying, followed by drying the coated fabric to obtain an ink jet recording sheet of Example 13. The surface of the ink receiving layer had an arithmetical mean roughness of 19 μm and a 75 specular gloss of 18.

EXAMPLE 14

The ink jet recording sheet obtained in Example 13 was subjected to calendering treatment (passing twice under a linear pressure of 160 kg/cm) to obtain an ink jet recording sheet of Example 14. The surface of the ink receiving layer had an arithmetical mean roughness of 14 μm and a 75° specular gloss of 28.

EXAMPLE 15

The ink jet recording sheet obtained in Example 13 was subjected to calendering treatment (passing twice under a linear pressure of 240 kg/cm) to obtain an ink jet recording sheet of Example 15. The surface of the ink receiving layer had an arithmetical mean roughness of 5 μm and a 75° specular gloss of 37.

EXAMPLE 16

One side of a polyester fabric (a plain weave fabric comprising filament yarns of 100 μm in diameter) as a support was coated with Solution 1 for pigment layer by a wire bar so as to give a coating amount of 100 g/m$^2$ after drying, followed by drying the coated fabric. Then, Solution 2 for ink receiving layer was coated on the pigment layer by a wire bar so as to give a coating amount of 10 g/m$^2$ after drying and was dried to obtain an ink jet recording sheet of Example 16. The surface of the ink receiving layer had an arithmetical mean roughness of 17 μm and a 75° specular gloss of 20.

EXAMPLE 17

The ink jet recording sheet obtained in Example 16 was subjected to calendering treatment (passing twice under a linear pressure of 160 kg/cm) to obtain an ink jet recording sheet of Example 17. The surface of the ink receiving layer had an arithmetical mean roughness of 10 μm and a 75° specular gloss of 32.

EXAMPLE 18

The ink jet recording sheet obtained in Example 16 was subjected to calendering treatment (passing twice under a linear pressure of 240 kg/cm) to obtain an ink jet recording sheet of Example 18. The surface of the ink receiving layer had an arithmetical mean roughness of 2 μm and a 75° specular gloss of 36.

EXAMPLE 19

An ink jet recording sheet of Example 19 was obtained in the same manner as in Example 13, except that the fabric used was changed to a plain weave polyester fabric comprising yarns having a diameter of 230 μm. The surface of the ink receiving layer had an arithmetical mean roughness of 30 μm and a 75° specular gloss of 13.

EXAMPLE 20

The ink jet recording sheet obtained in Example 19 was subjected to calendering treatment (passing twice under a linear pressure of 160 kg/cm) to obtain an ink jet recording sheet of Example 20. The surface of the ink receiving layer had an arithmetical mean roughness of 8 μm and a 75° specular gloss of 38.

EXAMPLE 21

The ink jet recording sheet obtained in Example 19 was subjected to calendering treatment (passing twice under a linear pressure of 240 kg/cm) to obtain an ink jet recording sheet of Example 21. The surface of the ink receiving layer had an arithmetical mean roughness of 12 μm and a 75° specular gloss of 35.

EXAMPLE 22

An ink jet recording sheet of Example 22 was obtained in the same manner as in Example 16, except that the fabric used was changed to a plain weave polyester fabric comprising yarns having a diameter of 230 μm. The surface of the ink receiving layer had an arithmetical mean roughness of 15 μm and a 75° specular gloss of 23.

EXAMPLE 23

The ink jet recording sheet obtained in Example 22 was subjected to calendering treatment (passing twice under a linear pressure of 160 kg/cm) to obtain an ink jet recording sheet of Example 23. The surface of the ink receiving layer had an arithmetical mean roughness of 8 μm and a 75° specular gloss of 40.

EXAMPLE 24

The ink jet recording sheet obtained in Example 22 was subjected to calendering treatment (passing twice under a linear pressure of 240 kg/cm) to obtain an ink jet recording sheet of Example 24. The surface of the ink receiving layer had an arithmetical mean roughness of 7 μm and a 75° specular gloss of 42.

EXAMPLE 25

One side of a polyester fabric (a plain weave fabric comprising filament yarns of 230 μm in diameter) as a support was coated with Solution 2 for pigment layer by a wire bar so as to give a coating amount of 100 g/m$^2$ after drying, followed by drying the coated fabric. Then, Solution 3 for ink receiving layer was coated on the pigment layer by a wire bar so as to give a coating amount of 15 g/m$^2$ after drying and was dried to obtain an ink jet recording sheet of Example 25. The surface of the ink receiving layer had an arithmetical mean roughness of 14 μm and a 75° specular gloss of 17.

EXAMPLE 26

An ink jet recording sheet of Example 26 was obtained in the same manner as in Example 25, except that Solution 2 for ink receiving layer was used in place of Solution 3 for ink receiving layer. The surface of the ink receiving layer had an arithmetical mean roughness of 14 μm and a 75° specular gloss of 17.

EXAMPLE 27

An ink jet recording sheet of Example 27 was obtained in the same manner as in Example 25, except that Solution 4 for ink receiving layer was used in place of Solution 3 for ink receiving layer. The surface of the ink receiving layer had an arithmetical mean roughness of 14 μm and a 75° specular gloss of 16.

EXAMPLE 28

An ink jet recording sheet of Example 28 was obtained in the same manner as in Example 25, except that Solution 5 for ink receiving layer was used in place of Solution 3 for ink receiving layer. The surface of the ink receiving layer had an arithmetical mean roughness of 15 μm and a 75° specular gloss of 15.

EXAMPLE 29

An ink jet recording sheet of Example 29 was obtained in the same manner as in Example 25, except that Solution 6 for ink receiving layer was used in place of Solution 3 for ink receiving layer. The surface of the ink receiving layer had an arithmetical mean roughness of 15 μm and a 75° specular gloss of 15.

EXAMPLE 30

An ink jet recording sheet of Example 30 was obtained in the same manner as in Example 25, except that Solution 7 for ink receiving layer was used in place of Solution 3 for ink receiving layer. The surface of the ink receiving layer had an arithmetical mean roughness of 10 μm and a 75° specular gloss of 19.

Comparative Example 1

An ink jet recording sheet of Comparative Example 1 was obtained in the same manner as in Example 1, except that a polyester fabric (a plain weave fabric comprising filament yarns having a diameter of 1200 μm) was used as the support in place of the polyester fabric (a plain weave fabric comprising filament yarns having a diameter of 100 μm). The surface of the ink receiving layer had an arithmetical mean roughness of 51 μm and a 75° specular gloss of 2.

Comparative Example 2

An ink jet recording sheet of Comparative Example 2 was obtained in the same manner as in Example 4, except that a polyester fabric (a plain weave fabric comprising filament yarns having a diameter of 1200 μm) was used in place of the polyester fabric (a plain weave filament comprising filament yarns having an outer diameter of 100 μm) as the support. The surface of the ink receiving layer had an arithmetical mean roughness of 45 μm and a 75° specular gloss of 3.

Comparative Example 3

An ink jet recording sheet of Comparative Example 3 was obtained in the same manner as in Example 13, except that a polyester fabric (a plain weave fabric comprising filament yarns having a diameter of 1200 μm) was used in place of the polyester fabric (a plain weave fabric comprising filament yarns having a diameter of 100 μm) as the support. The surface of the ink receiving layer had an arithmetical mean roughness of 46 μm and a 75° specular gloss of 3.

Comparative Example 4

An ink jet recording sheet of Comparative Example 4 was obtained in the same manner as in Example 16, except that a polyester fabric (a plain weave fabric comprising filament yarns having a diameter of 1200 μm) was used in place of the polyester fabric (a plain weave fabric comprising filament yarns having a diameter of 100 μm) as the support. The surface of the ink receiving layer had an arithmetical mean roughness of 43 μm and a 75° specular gloss of 4.

Comparative Example 5

An ink jet recording sheet of Comparative Example 5 was obtained in the same manner as in Example 13, except that a paper having a basis weight of 250 g/m$^2$ was used in place of the polyester fabric (a plain weave fabric comprising filament yarns having a diameter of 100 μm) as the support. The surface of the ink receiving layer had an arithmetical mean roughness of 1 μm and a 75° specular gloss of 24.

Comparative Example 6

An ink jet recording sheet of Comparative Example 6 was obtained in the same manner as in Example 16, except that a paper having a basis weight of 250 g/m$^2$ was used in place of the polyester fabric (a plain weave fabric comprising filament yarns having a diameter of 100 μm) as the support. The surface of the ink receiving layer had an arithmetical mean roughness of 1 μm and a 75° specular gloss of 40.

Test methods (1) Print Density

Each of the recording sheets produced in the examples and the comparative examples was cut to a size of A4, and then the sheet was subjected to solid printing of each 100% of black color, cyan color, magenta color and yellow color by an ink jet printer (Desk Jet 2500CP manufactured by HP Co., Ltd. with UV ink). Density of each printed portion was measured by Macbeth RD919. The greater value means the higher print density and the better printability.

(2) Appearance

C) Each of the recording sheets produced in the c; examples and the comparative examples was cut to a size of A0, and then the sheet was subjected to printing of a suitable oil painting by an ink jet printer (JV2-130 manufactured by Mimaki Engineering Co., Ltd.). The printed recording sheet was stuck on a wood frame and set in a picture frame for oil painting. This was hung on a wall and visually observed at a distance of about 5 m therefrom. The printed sheet which showed an appearance closer to the oil painting was judged to be good in appearance and evaluated by 5 grades. The grade 5 is the best, and the grade 3 or higher means that the print looks like a painting.

(3) Gloss of Print

Each of the ink jet recording sheets produced in the examples and the comparative examples was cut to a size of A4, and then the sheet was subjected to solid printing of 100% magenta color by an ink jet printer (Desk Jet 2500CP manufactured by HP Co., Ltd. with UV ink). Then, the 60° gloss of the solid printed portion was measured by a gloss meter (digital gloss meter Model GM-26D manufactured by Murakami Shikisai Gijutsu Kenkyusho), and this was taken as a gloss of the print. The higher value means that the print has the higher gloss and shows feeling closer to the oil painting.

TABLE 1

| | Print density | | | | | Gloss of |
|---|---|---|---|---|---|---|
| | Black | Cyan | Magenta | Yellow | Appearance | print |
| Example 1 | 1.38 | 1.14 | 1.18 | 1.10 | 3 | 7.9 |
| Example 2 | 1.53 | 1.24 | 1.29 | 1.22 | 4 | 15.2 |
| Example 3 | 1.58 | 1.28 | 1.35 | 1.28 | 4 | 16.4 |
| Example 4 | 1.36 | 1.14 | 1.20 | 1.08 | 3 | 11.0 |
| Example 5 | 1.56 | 1.26 | 1.32 | 1.25 | 4 | 15.8 |
| Example 6 | 1.55 | 1.27 | 1.32 | 1.26 | 3 | 16.7 |
| Example 7 | 1.42 | 1.20 | 1.21 | 1.19 | 3 | 7.1 |
| Example 8 | 1.52 | 1.24 | 1.34 | 1.27 | 4 | 15.6 |
| Example 9 | 1.57 | 1.28 | 1.34 | 1.27 | 4 | 16.0 |
| Example 10 | 1.50 | 1.26 | 1.29 | 1.21 | 3 | 8.3 |
| Example 11 | 1.55 | 1.27 | 1.33 | 1.26 | 4 | 16.1 |
| Example 12 | 1.56 | 1.29 | 1.36 | 1.27 | 4 | 17.3 |
| Example 13 | 1.51 | 1.30 | 1.32 | 1.29 | 4 | 14.9 |
| Example 14 | 1.60 | 1.32 | 1.37 | 1.30 | 5 | 19.4 |
| Example 15 | 1.64 | 1.38 | 1.37 | 1.34 | 5 | 20.4 |
| Example 16 | 1.50 | 1.29 | 1.32 | 1.30 | 4 | 16.3 |
| Example 17 | 1.62 | 1.34 | 1.34 | 1.30 | 5 | 19.7 |
| Example 18 | 1.66 | 1.38 | 1.37 | 1.35 | 4 | 20.9 |
| Example 19 | 1.52 | 1.32 | 1.33 | 1.33 | 5 | 15.3 |
| Example 20 | 1.63 | 1.37 | 1.36 | 1.33 | 5 | 21.0 |
| Example 21 | 1.62 | 1.33 | 1.34 | 1.28 | 5 | 19.1 |
| Example 22 | 1.51 | 1.32 | 1.32 | 1.31 | 5 | 18.8 |
| Example 23 | 1.60 | 1.37 | 1.35 | 1.35 | 5 | 22.7 |
| Example 24 | 1.61 | 1.36 | 1.37 | 1.31 | 5 | 21.6 |
| Example 25 | 1.60 | 1.39 | 1.37 | 1.38 | 5 | 16.9 |
| Example 26 | 1.62 | 1.39 | 1.36 | 1.35 | 5 | 16.8 |
| Example 27 | 1.60 | 1.37 | 1.36 | 1.36 | 5 | 16.7 |
| Example 28 | 1.59 | 1.36 | 1.33 | 1.32 | 5 | 16.4 |
| Example 29 | 1.56 | 1.35 | 1.33 | 1.33 | 5 | 16.5 |
| Example 30 | 1.61 | 1.38 | 1.36 | 1.37 | 5 | 17.1 |
| Comparative Example 1 | 1.29 | 1.10 | 1.16 | 1.08 | 1 | 4.0 |
| Comparative Example 2 | 1.33 | 1.12 | 1.11 | 1.05 | 1 | 5.0 |
| Comparative Example 3 | 1.41 | 1.19 | 1.20 | 1.16 | 2 | 5.2 |
| Comparative Example 4 | 1.50 | 1.28 | 1.29 | 1.27 | 2 | 9.8 |
| Comparative Example 5 | 1.67 | 1.37 | 1.35 | 1.36 | 1 | 18.6 |
| Comparative Example 6 | 1.66 | 1.36 | 1.37 | 1.34 | 1 | 22.3 |

Evaluation

As can be seen from Table 1, the ink jet recording sheets of Examples 114 30 which are according to the present invention have good appearance looking like oil paintings, and especially those of Examples 4–6, 10–12, 16–18 and 22–24 which have pigment layers are better in gloss after printing and have appearance closer to oil paintings than those of Examples 1–3, 7–9, 13–15 and 19–21 which have no corresponding pigment layer. Furthermore, it can be seen that when woven fabrics comprising yarns having a diameter of not less than 200 μm are used as supports, the resulting prints are apparently closer to oil paintings with causing no great change in arithmetical mean roughness and 75° specular gloss of the surface of the ink receiving layer (Examples 7–12 and 19–24). Moreover, it can be seen that when a gas phase method silica is contained in the ink receiving layer, the glossy feeling is further improved and, as a result, the print density is further improved and thus the gloss of print is also improved, and better images looking like oil paintings can be printed (Examples 13–30). On the other hand, in Comparative Examples 1–4 where the arithmetical mean roughness and the 75° specular gloss are outside those specified in the present invention, the print density and the gloss of print are lower, and therefore the appearance is far from an oil painting. Furthermore, in Comparative Examples 5 and 6, not a fabric, but a paper is used as the support, and, hence, the appearance is utterly different from the feeling of an oil painting.

INDUSTRIAL APPLICABILITY

When an oil painting is printed using the ink recording sheet of the present invention, an image looking like the oil painting can be obtained without subjecting to other treatments after printing, and thus the ink receiving sheet is useful.

What is claimed is:

1. An ink jet recording sheet comprising a support and an ink receiving layer provided on one side of the support, the support being a fabric and having a pigment layer on at least the side on which the ink receiving layer is provided or is impregnated with a pigment component, wherein the fabric is a woven fabric comprising yarns having a diameter of 100–1,000 μm and the surface of the ink receiving layer has an arithmetical mean roughness of not more than 30 μm measured in accordance with JIS B0601.

2. An ink jet recording sheet according to claim 1, wherein the surface of the ink receiving layer has a 75° specular gloss of not less than 10 measured in accordance with JIS P8142.

3. An ink jet recording sheet according to claim 1, wherein the fabric is a woven fabric comprising yarns having a diameter of not less than 200 μm.

4. An ink jet recording sheet according to claim 2, wherein the fabric is a woven fabric comprising yarns having a diameter of not less than 200 μm.

5. An ink jet recording sheet according to claim 1, wherein the ink receiving layer contains a gas phase method silica.

6. An ink jet recording sheet according to claim 2, wherein the ink receiving layer contains a gas phase method silica.

7. An ink jet recording sheet according to claim 3, wherein the ink receiving layer contains a gas phase method silica.

8. An ink jet recording sheet according to claim 5, wherein the gas phase method silica has an average primary particle diameter of 3–40 nm and a specific surface area of not less than 50 $m^2/g$ measured by BET method.

9. An ink jet recording sheet according to claim 6, wherein the gas phase method silica has an average primary particle diameter of 3–40 nm and a specific surface area of not less than 50 $m^2/g$ measured by BET method.

10. An ink jet recording sheet according to claim 7, wherein the gas phase method silica has an average primary particle diameter of 3–40 nm and a specific surface area of not less than 50 $m^2/g$ measured by BET method.

* * * * *